US009463482B2

(12) United States Patent
Barron

(10) Patent No.: US 9,463,482 B2
(45) Date of Patent: Oct. 11, 2016

(54) METERING DEVICE

(71) Applicant: Robert Bosch GmbH, Stuttgart (DE)
(72) Inventor: Dan Barron, Schaffhausen (CH)
(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/440,626
(22) PCT Filed: Oct. 24, 2013
(86) PCT No.: PCT/EP2013/072267
§ 371 (c)(1),
(2) Date: May 5, 2015
(87) PCT Pub. No.: WO2014/072185
PCT Pub. Date: May 15, 2014

(65) Prior Publication Data

US 2015/0298148 A1 Oct. 22, 2015

(30) Foreign Application Priority Data

Nov. 6, 2012 (DE) ..... 10 2012 220 190

(51) Int. Cl.
*B05B 11/04* (2006.01)
*A47G 19/18* (2006.01)
*B05B 9/08* (2006.01)

(52) U.S. Cl.
CPC ..... *B05B 11/048* (2013.01); *A47G 19/183* (2013.01); *B05B 9/0861* (2013.01); *B05B 9/0838* (2013.01)

(58) Field of Classification Search
USPC ..... 222/103, 105, 325–327, 386
See application file for complete search history.

(56) References Cited

U.S. PATENT DOCUMENTS 2,903,161 A * 9/1959 Stahmer ..... B65D 35/28 222/103
5,836,482 A 11/1998 Ophardt
6,554,164 B1 * 4/2003 Jones ..... B65D 77/068 222/105
2004/0124211 A1 * 7/2004 Jones ..... B65D 83/0077 222/105
2011/0220652 A1 * 9/2011 Corbett ..... B65D 77/06 220/495.03
2012/0168461 A1 * 7/2012 Topits ..... B65D 47/0804 222/105

FOREIGN PATENT DOCUMENTS

WO 2004086731 10/2004
WO 2004106184 12/2004
WO 2006077574 7/2006

OTHER PUBLICATIONS

International Search Report for Application No. PCT/EP2013/072267 dated Apr. 3, 2014 (English Translation, 2 pages).

* cited by examiner

*Primary Examiner* — Donnell Long
(74) *Attorney, Agent, or Firm* — Michael Best & Friedrich LLP

(57) ABSTRACT

The invention relates to a metering device consisting of—a housing (1) for receiving an interchangeable container, said container being connected to a disposable pump (10), —an electric drive motor (6) for driving the disposable pump (10), —control means for controlling said drive motor (6) and for influencing the pump volume, —an electric current source or an electric connection for supplying energy to the electric drive motor (6) and the control means, said housing (1) additionally having a receiving portion (11) for form-fittingly retaining the disposable pump (10), —said housing (1) comprising two pivotally interconnected partial shells (7*a*, 7*b*) and—one elastic squeezing element (12*a*, 12*b*) being secured to each partial shell (7a, 7b), the interchangeable container being clamped between these, and the metering device being suitable for receiving interchangeable containers in the form of non-dimensionally stable, hanger-free tubular pouches (8).

12 Claims, 4 Drawing Sheets

METERING DEVICE

BACKGROUND OF THE INVENTION

The invention relates to a metering device with a housing for receiving a replaceable receptacle, wherein the receptacle is connected to a disposable pump.

Metering devices with a housing for receiving a replaceable container, in the majority of cases a refillable container, have naturally been known per se for a long time. They are used for the controlled, rapid and automatic delivery of a mostly liquid or at least flowable substance, thus for example in the case of soap dispensers, antiseptic skin cleansers, liquid medical substances and the like, very frequently and increasingly, however, also in the foodstuff and gastronomy sector where, for example, beverages, juices, sauces, soups or semi-liquid additives such as mustard, ketchup, mayonnaise and the like have to be delivered in portions with handling costs that are as low as possible, however nevertheless meeting predefined hygiene standards. Most recently, precisely because of the hygiene requirements, manufacturers have started to provide the refillable containers themselves, which contain the refillable substances in aseptically packaged form, with disposable pumps which are already connected or are at least easily connectable. Single use of pumps has clear advantages for it is adequately known that fixedly installed pumps or conveying mechanisms can often only be cleaned and made available for renewed use in a hygienically satisfactory state at great expense. This is why refillable containers with disposable pumps connected thereto make particular sense.

U.S. Pat. No. 5,836,482 shows a metering device for liquids which is suitable for receiving containers with disposable pumps connected thereto. Said metering device has a housing for receiving a replaceable receptacle, an electric drive motor for driving the disposable pump, control means for controlling the drive motor and for influencing the pump volume as well as an electric power source for supplying energy to the electric drive motor and the control means. In addition, the housing has a receiving means for mounting the disposable pump in a positive locking manner. The receiving means for mounting the disposable pump in a positive locking manner in this case is developed such that, when the disposable pump is inserted into the positive-locking mounting, the axis of the drive motor is coupled in a forcibly actuated and non-rotatable manner with the axis of an impeller wheel of the disposable pump. The disposable pump is realized as a positive displacement pump and has two interlocking impeller wheels.

The device according to U.S. Pat. No. 5,836,482 is realized in principle for dimensionally rigid replaceable receptacles, however it also shows an embodiment with a flexible bag with a strengthening or mounting or suspending means molded on one side which serves on the one hand for the purpose of providing embedded button cells for providing energy, on the other hand however also exerts a holding function in order to prevent the full or also part-drained flexible bag from collapsing into itself. All disclosed realization variants of U.S. Pat. No. 5,836,482 consequently show solutions where the dimensional stability of the replaceable receptacle is present or remains constant.

In principle, the fact is that the collapsing of a flexible refillable receptacle during the draining operation should be avoided where possible because it has been shown again and again namely that when there is premature collapse a relatively large proportion of the contents remains in the flexible container. During collapsing, the resultant fold points become insurmountable outlet obstructions. The pump used is no longer able to drain the container contents in such cases and the resultant bag and contents wastage is naturally highly undesirable.

SUMMARY OF THE INVENTION

Consequently the object of the present invention consists in providing a generic metering device which is able to receive simple tubular bags which collapse in on themselves during draining Satisfactory operation of the metering device is to be ensured nevertheless during the entire draining operation and the tubular bags are to be correspondingly drainable at least approximately completely.

The solution includes that in the case of a generic metering device the housing of the metering device comprises two part shells which are connected together so as to be pivotable, and that one elastic squeezing element each is fastened on each part shell, between which elastic squeezing elements the tubular bag is held in a clamping manner. The main advantage is naturally that it is possible to use non-dimensionally stable receptacles which are simple to produce, that is common tubular bags with relatively thin walls and without specially integrally molded suspending means or other means for preserving the dimensional stability. Said possibility to be able to use tubular bags which are free of suspending means is a very substantial simplification and it naturally also means a large material saving when producing the tubular bags. With the quantities of refillable containers arising in practice, this is highly relevant just for ecological reasons.

The present invention is suitable in principle both for stationary and also for portable or mobile embodiments. Thus, it is possible to produce portable and even single-handedly operable, virtually pistol-like metering devices which can be used in almost arbitrary positions of use.

In principle, it can be assumed that non-dimensionally stable tubular bags in the intact state—that is prior to being used—nevertheless comprise a certain inherent minimum dimensional stability. This means that it does not need any or hardly any dimensionally-supportive measures at the start of the draining operation. In the course of the draining operation, however, these become more and more important in order to avoid the mentioned collapsing of the tubular bag. Said supporting function, which gradually becomes more and more important and effective, is brought about by the two elastic squeezing elements which are mounted on the part shells of the housing and between which the tubular bag is held in a clamping manner.

The squeezing elements are supporting elements which are very simple to produce, substantially flat, easy to replace and act in a reliable manner. They are preferably arranged in a central and top part of the housing or in a part of the housing that is remote from the outlet because in the case of tubular bags precisely in said region the flowing of the bag contents to regions close to the outlet has to be especially encouraged. The squeezing elements overall with the associated connecting elements to the part shells of the housing are consequently preferably realized as flexibly resilient flaps or as elastic membranes, between which the non-dimensionally stable tubular bag is held in a clamping manner. The flexibly resilient action can be obtained in a known manner both by the manner of the connection and by the suitable elasticity of the material chosen and should be well known to the expert. The exemplary embodiment shown uses guide groove/guide web connections which are simple to mount and to replace as well as preferably elastic plastics materials.

The squeezing elements themselves can be provided with suitable ribs and further moldings to strengthen the action in order to press the tubular bag contents where possible in all draining and storage states (the latter particularly in the case of hand-held devices) in as reliable a manner as possible in the direction of the tubular bag outlet.

BRIEF DESCRIPTION OF THE DRAWINGS

Examples of the metering device according to the invention are explained in more detail below by way of drawings, in which.

DETAILED DESCRIPTION

Figure 1:
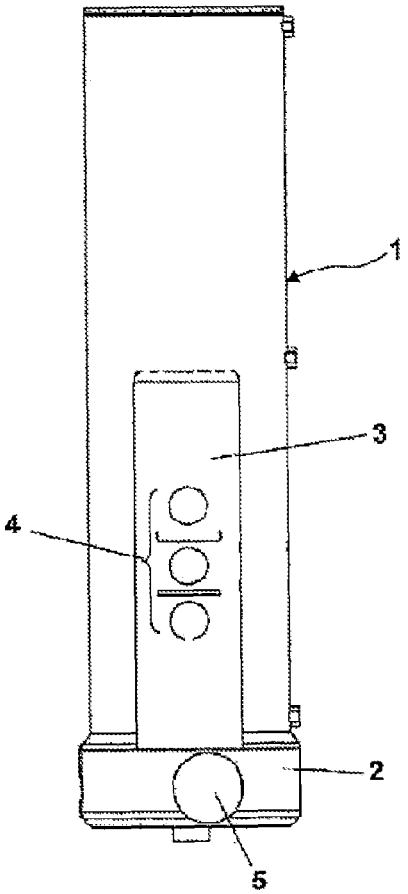
FIG. 1 shows a front view of a first embodiment of the invention.

FIG. 1 shows a front view of a first embodiment of the invention. Said embodiment is suitable to be set up on flat surfaces. In the case of said metering device, a housing 1 for receiving a replaceable flexible container (see FIG. 2 also in this respect) comprises a base part. The base part consists substantially of a pump drive housing 2 and a shaft 3 which projects vertically upward from said pump housing. Operating elements 4, for example push-buttons to discharge different sized portions (see FIG. 4 also in this respect), are arranged on the shaft 3. The pump drive housing 2 can comprise a housing molding 5 for the drive motor 6 (see FIG. 5 also in this respect).

Figure 2:
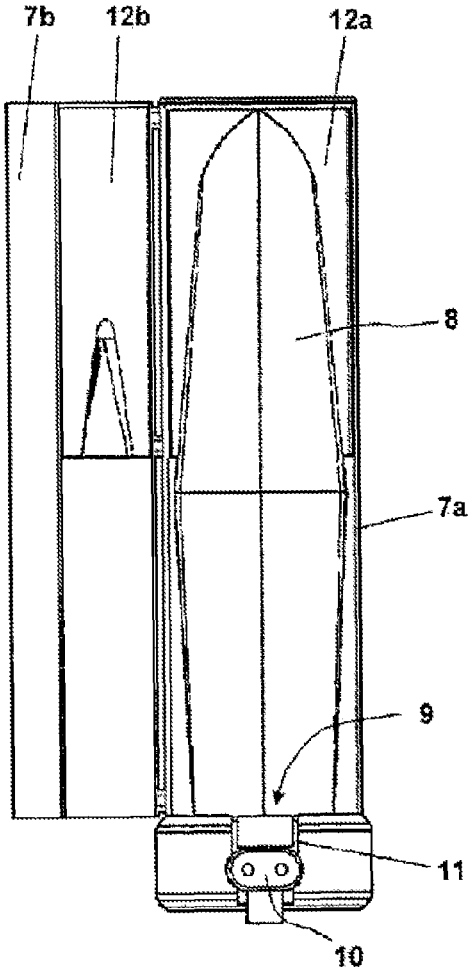
FIG. 2 shows a rear view of the first embodiment with the part shells open.

FIG. 2 shows a rear view of the first embodiment with part shells that are open. In said representation the housing 1 is open, said housing additionally comprises two part shells 7*a*, 7*b* which are connected together so as to be pivotable. In said embodiment the part shells 7*a*, 7*b* are realized as half shells. An inserted replaceable flexible receptacle in the manner of a tubular bag 8 can also be seen. The tubular bag 8 has a disposable pump 10 which is connected thereto at an outlet end 9. The pump drive housing 2 has a receiving means 11 for mounting the disposable pump 10 in a positive locking manner. Further details of the connection between the disposable pump 10 and the drive motor 6 which is effected when the tubular bag 8 is inserted into the metering device or of the insertion of the disposable pump 10 into the receiving means 11 are given in conjunction with FIGS. 4 and 5.

In addition, FIG. 2 shows a squeezing element 12*a*, 12*b* (see FIGS. 3 and 6 also in this respect) that is still inserted in the part shells 7*a*, 7*b*.

The tubular bag 8, as already mentioned in the introduction, is of a non-dimensionally stable type, otherwise, however, is free of specially integrally molded suspending means or other means for preserving the dimensional stability. It is therefore of a type which (when used freely) collapses in on itself during the draining process, but nevertheless in the filled form has a certain inherent minimum dimensional stability as indicated in FIG. 2. These types of tubular bags which are popular today are, as a rule, closed aseptically (in the delivery state) and have at their outlet end a spout onto which a closure or even a disposable pump can be screw-connected. The foil material of the tubular bag is not perforated or the bag opened until the disposable pump is screwed on or screwed tight. In order to be able to insert the tubular bag into the metering device according to the invention, the disposable pump must naturally be screwed onto the tubular bag beforehand. When inserted into the metering device, the tubular bag is therefore already open; as long as the disposable pump is not yet actuated, however, on account of the adhesion forces that act in the disposable pump the contents of the tubular bag do not flow out.

Figure 3:
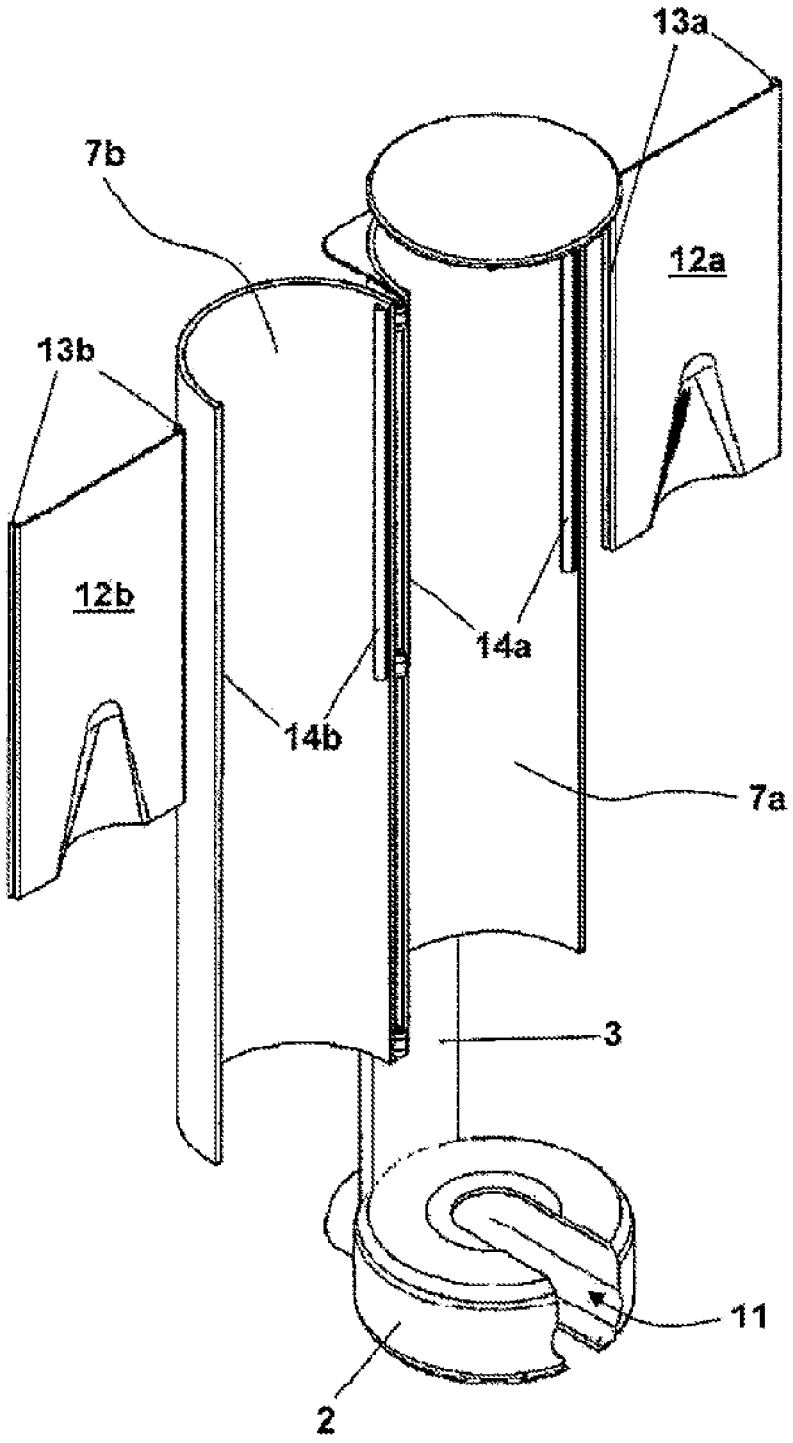
FIG. 3 shows a three-dimensional view of the first embodiment with the part shells open and the squeezing elements removed.

FIG. 3 shows a three-dimensional view of the first embodiment, with the part shells 7*a*, 7*b* open and squeezing elements 12*a*, 12*b* removed. A simply slight variation in the part shells 7*a*, 7*b* is shown here. Said part shells do not necessarily have to extend down as far as the pump drive housing 2 (as in FIGS. 1 and 2), which at the same time can have the advantage that the residual fill level of the tubular bag 8 is easier to see.

The elastic squeezing elements 12, 12*b*, which are not shown here, however, in the installation position but for greater clarity are shown separately, are realized in a substantially flat manner and are fastenable on the part shells 7*a*, 7*b* so as to be insertable. In addition, it can also be clearly seen that the elastic squeezing elements 12*a*, 12*b* are arranged in a top part of the housing 1 or in a part that is remote from the outlet.

For fastening the squeezing elements 12*a*, 12*b* on the part shells 7*a*, 7*b*, the elastic squeezing elements 12*a*, 12*b* have in each case on at least one longitudinal side one guide web 13*a*, 132*b* each , and the part shells 7*a*, 7*b* have in each case at least one guide groove 14*a*, 14*b* each which matches thereto. The guide webs 13*a*, 13*b* can in each case be pushed into the corresponding guide grooves 14*a*, 14*b*. Solutions where the squeezing elements 12*a*, 12*b* are fastened on one side or on both sides of the respective part shells 7*a*, 7*b* are also possible.

Figure 4:
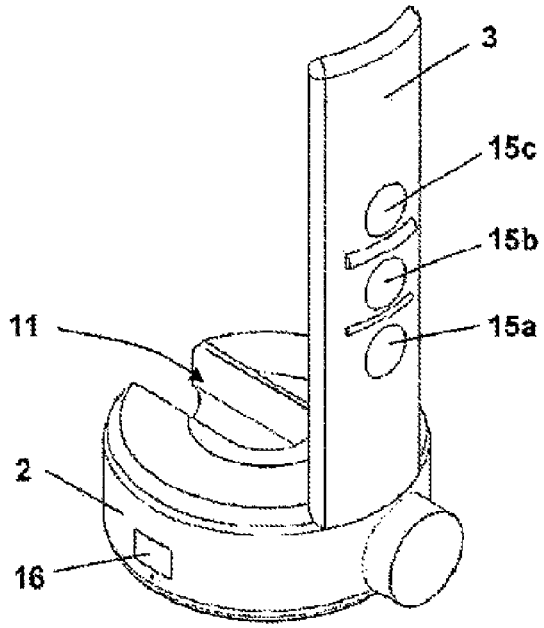
FIG. 4 shows a base part of the first embodiment.

FIG. 4 shows a base part of the first embodiment. For reasons of clarity, the part shells 7*a*, 7*b* have been left out of said representation. Control buttons 15*a*, 15*b*, 15*c* can be seen in a somewhat clearer manner here, for example the delivery can be started with the control button 15*a*, a 50% reduced portion can be delivered with the control button 15*b* and a 50% increased portion with the control button 15*c* . These are requirements that are frequently to be met in practice in the foodstuffs industry. In FIG. 4 it is also possible to see a display window 16 which is installed, for example, in the base part and in which, for example, the quantity delivered can be indicated. Obviously, it is also possible to have further or different display or control elements which are not shown.

Figure 5:
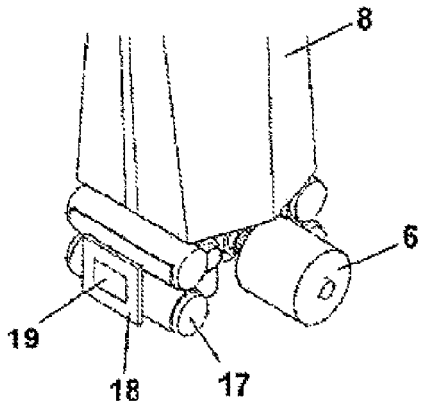
FIG. 5 shows a part schematic representation of the driving part.

FIG. 5 shows a part, schematic representation of the driving part in a manner as would be presented if in the representation according to FIG. 4 the pump drive housing 2 with the shaft 5 were left out, however for clarification with the tubular bag 8 inserted. It can be seen here that not only the electric drive motor 6 but also batteries 17 or battery packs for supplying energy to the drive motor and the control means as well as a control plate 18 and a display element 19 are accommodated in the pump drive housing 2. The control plate 18 can also comprise an adjustment button, for example, for adjusting the metering quantity (not shown). The control means overall, which naturally include the control plate 18 and the display element 19, are shown only as examples in said exemplary embodiment. Other arrangements and configurations are possible and, depending on the type of application of the metering device, also make sense. The advantage of said arrangement, however, consists in that the pump drive and the control means can be provided to a certain extent in modular form as a closed unit (base part with pump drive housing 2 and shaft 3), which naturally simplifies the maintenance of the device and consequently also reduces the costs.

Figure 6:
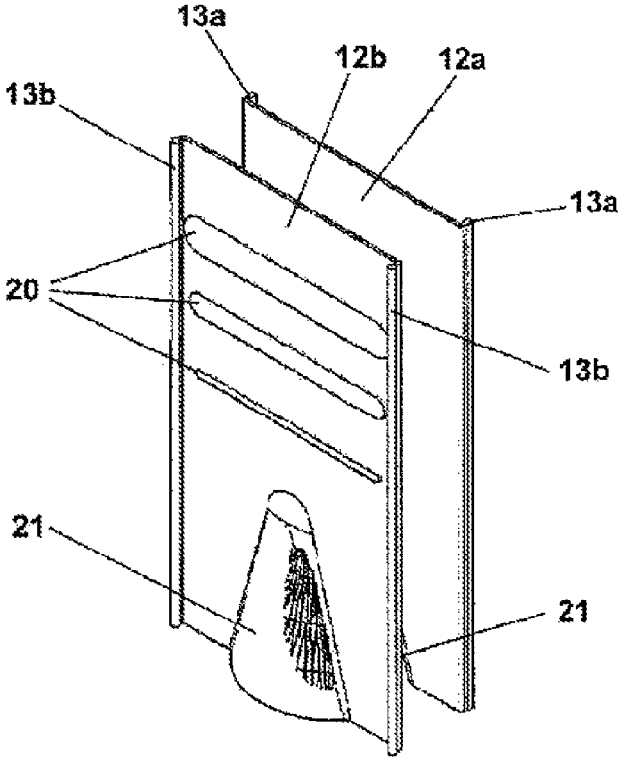
FIG. 6 shows a three-dimensional view of the squeezing elements in the operating position.

FIG. 6 shows a three-dimensional view of the squeezing elements 12*a*, 12*b* in the operating position. Here too, for reasons of clarity all non-essential references for installation which can be seen clearly, however, from the remaining figures and the description, have been omitted. Consequently, a tubular bag 8 would be clamped between the squeezing elements 12*a*, 12*b* in the installation state or in the operating position.

FIG. 6 also shows that the elastic squeezing elements 12*a*, 12*b* comprise integral ribs 20 with developments which, in the operating position, comprise a squeezing action which reduces toward the center of the tubular bag and an action which presses the contents of the tubular bag to the center of the tubular bag and to the outlet of the tubular bag. To this end, the uppermost ribs 20 (that is the most remote from the outlet) are the thickest and accordingly project the most into the space between the two elastic squeezing elements 12*a*, 12*b*. The bottom ribs 20 (closer to the outlet) are gradually thinner and gradually also project less into the space.

FIG. 6 additionally shows that the elastic squeezing elements comprise conical moldings 21 which in the operating position bring about or facilitate a concentration of the tubular bag contents in the direction of the center of the tubular bag and of the outlet of the tubular bag. To this end, the conical moldings 21 are developed such that, with reference to the space between the two elastic squeezing elements 12*a*, 12*b*, they create a cavity into which the contents pushed by the ribs 20 are able to flow. The conical form is chosen such that the clamped tubular bag 8 can always take on as optimum a form as possible for increasing the draining reliability.

In principle, it must also be noted that with reference to the draining reliability the uppermost third up to approximately the top half of the tubular bag has proved to be a critical zone—naturally also in dependence on the effective height and the form of the tubular bag. This is also why the elastic squeezing elements 12*a*, 12*b* with the ribs 20 and the conical molding 21 are arranged in the top part of the housing (10) or in the part that is remote from the outlet.

It is obviously possible for the details of the ribs 20 and the moldings 21 to be developed in a different manner. Thus, the development of the detail could also be matched for example to the tubular bag contents or to the flowability thereof. Likewise, instead of the squeezing elements shown, other similarly acting mechanical means can also be used.

Figure 7:
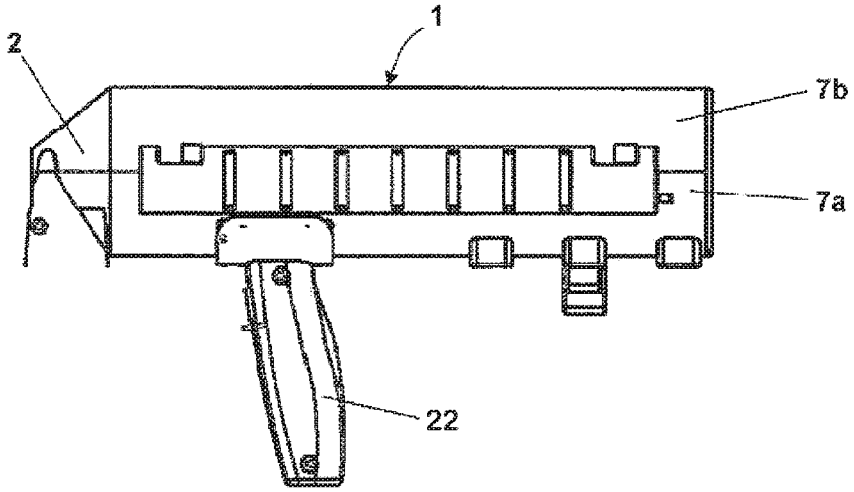
FIG. 7 shows a side view of a second embodiment of the invention as a hand-held device and FIG. 8 shows a three-dimensional view of a third embodiment of the invention in a carousel stand arrangement.

FIG. 7 shows another side view of a second embodiment of the metering device according to the invention as a hand-held device. Just as the first embodiment shown, the hand-held device also comprises a housing 1 with two part shells 7*a*, 7*b*. The part shells 7*a*, 7*b* are also realized in this case as half shells. In addition, the housing 1 of the metering device that is realized as a hand-held device also has a pump drive housing 2 on an end on the outlet side. The pump drive housing 2 is simply slightly differently developed in shape in order to take account of the ergonomic requirements of hand-held operation. However, a pistol grip 22 is situated on the housing 1 with the necessary (simply indicated) operating elements. As already mentioned earlier, the structural concept with the housing part shells and the elastic squeezing elements is also suitable in principle for applications with the tubular bag in an inclined position or in a horizontal position, which is why metering devices in the form of hand-held devices, although possibly also with developments of detail other than those in the embodiment shown in FIG. 7, can make absolute sense and be advantageous.

Figure 8:
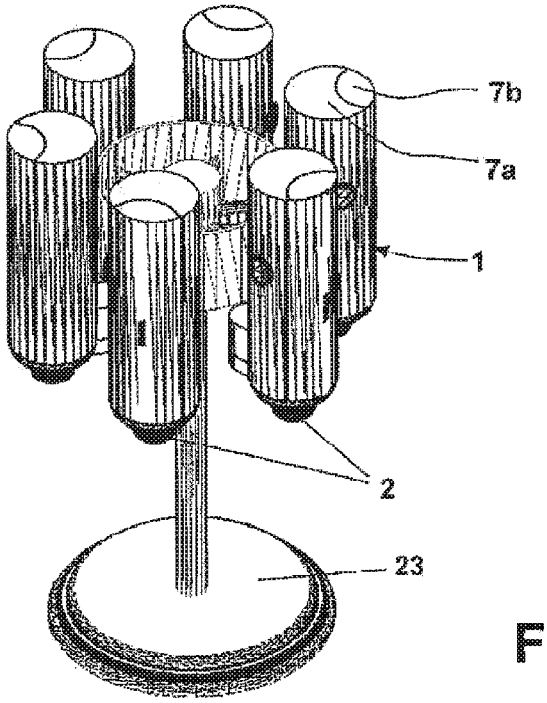

FIG. 8 finally shows another three-dimensional view of a third embodiment of the invention in a carousel stand arrangement. In particular in the gastro sector, for example in fast food restaurants, it can make absolute sense for the rapid and controlled preparation of meals or beverages according to usual standard sizes, to have available complete batteries of suitable metering devices. Carousel stand arrangements are particularly well suited here because the distances that have to be covered by the service staff can be minimized and because accessibility is always guaranteed. The metering device battery shown here with a carousel stand arrangement is, however, merely put forward as an outline because individual developments can naturally also be just as different as for the embodiments described previously. Just as the embodiments shown up to now, here too each individual device comprises a housing 1 with two part shells 7*a*, 7*b*. The part shells 7*a*, 7*b* here, however, are not realized as half shells but as differently sized part shells. The expert should not have any difficulty in seeing that even with differently sized part shells, the concept proposed up to now with the elastic squeezing elements can be realized just as well even though the guide grooves for the squeezing elements are arranged in a different manner. In addition, here too each individual device has a pump drive housing 2 on an end on the outlet side.

Because the embodiment shown in FIG. 8 is naturally rather a device for efficient industrial use, it should naturally make sense to provide the energy supply no longer based on batteries for each individual device but rather to provide a centralized power supply for all the individual devices. For logical reasons the power or the power connection will then naturally be supplied in a centralized manner by means of the carousel stand 23.

Obviously, it must also be noted in this context that, in principle, in the case of all the realization variants shown it is possible to provide an easily workable charging device for the batteries or an electric power connection, for example for mains operation.

The invention claimed is:

1. A metering device, comprising a housing (1) configured to receive a replaceable receptacle, wherein the receptacle is connected to a disposable pump (10), an electric drive motor (6) configured to drive the disposable pump (10), control means for controlling the drive motor (6) and for influencing the pump volume, an electric power source or an electric connection configured to supply energy to the electric drive motor (6) and the control means, and wherein the housing (1) additionally comprises a receiving means (11) for mounting the disposable pump (10) in a positive locking manner, characterized in that the housing (1) comprises two part shells (7a, 7b) which are connected together so as to be pivotable and that one elastic squeezing element (12*a*, 12*b*) each is fastened on each part shell (7*a*, 7*b*), between which elastic squeezing elements the replaceable receptacle is held in a clamping manner, wherein the metering device is configured to receive non-dimensionally stable tubular bags (8) without suspending means, characterized in that the elastic squeezing elements (12*a*, 12*b*) are arranged in a top part of the housing (1) or in a part that is remote from the outlet.

2. The metering device as claimed in claim 1, characterized in that on an outlet side of the housing (1) the metering device comprises a pump drive housing (2) in which or on which the drive motor (6) is housed or mounted.

3. The metering device as claimed in claim 1, characterized in that the metering device comprises a pistol grip (22) on the housing (1).

4. The metering device as claimed in claim 1, characterized in that the metering device is configured to be fastened on a multiple-carrier device or on a carousel stand (23).

5. The metering device as claimed in claim 1, characterized in that the elastic squeezing elements (12*a*, 12*b*) are substantially flat and are configured to be fastened on the part shells (7*a*, 7*b*) so as to be insertable.

6. The metering device as claimed in claim 5, characterized in that the elastic squeezing elements (12*a*, 12*b*) comprise in each case a guide web (13*a*, 13*b*) on at least one longitudinal side and said guide web is insertable in each case into a corresponding guide groove (14*a*, 14*b*) on a part shell (7*a*, 7*b*).

7. The metering device as claimed in claim 6, characterized in that the elastic squeezing elements (12*a*, 12*b*) which have been inserted into the guide grooves (14*a*, 14*b*) by means of the guide webs (13*a*, 13*b*) are flexible flaps or act as flexible flaps, wherein the non-dimensionally stable tubular bag (8) is held in a clamping manner between the squeezing elements (12*a*, 12*b*).

8. The metering device as claimed in claim 5, characterized in that the elastic squeezing elements (12*a*, 12*b*) comprise integral ribs (20) with developments which in an operating position comprise a squeezing action which decreases toward a center of the tubular bag (8) and an action which presses contents of the tubular bag to the center of the tubular bag and to an outlet of the tubular bag.

9. The metering device as claimed in claim 5, characterized in that the elastic squeezing elements (12*a*, 12*b*) comprise conical moldings (21) which in an operating position bring about or facilitate concentration of contents of the tubular bag in a direction of a center of the tubular bag and of an outlet of the tubular bag.

10. A metering device, comprising a housing (1) configured to receive a replaceable receptacle, wherein the receptacle is connected to a disposable pump (10), an electric drive motor (6) configured to drive the disposable pump (10), control means for controlling the drive motor (6) and for influencing the pump volume, an electric power source or an electric connection configured to supply energy to the electric drive motor (6) and the control means, and wherein the housing (1) additionally comprises a receiving means (11) for mounting the disposable pump (10) in a positive locking manner, characterized in that the housing (1) comprises two part shells (7*a*, 7*b*) which are connected together so as to be pivotable and that one elastic squeezing element (12*a*, 12*b*) each is fastened on each part shell (7*a*, 7*b*), between which elastic squeezing elements the replaceable receptacle is held in a clamping manner, wherein the metering device is configured to receive non-dimensionally stable tubular bags (8) without suspending means, characterized in that the elastic squeezing elements (12*a*, 12*b*) are substantially flat and are configured to be fastened on the part shells (7*a*, 7*b*) so as to be insertable, and characterized in that the elastic squeezing elements (12*a*, 12*b*) comprise in each case a guide web (13*a*, 13*b*) on at least one longitudinal side and said guide web is insertable in each case into a corresponding guide groove (14*a*, 14*b*) on a part shell (7*a*, 7*b*).

11. The metering device as claimed in claim 10, characterized in that the elastic squeezing elements (12*a*, 12*b*) which have been inserted into the guide grooves (14*a*, 14*b*) by means of the guide webs (13*a*, 13*b*) are flexible flaps or act as flexible flaps, wherein the non-dimensionally stable tubular bag (8) is held in a clamping manner between the squeezing elements (12*a*, 12*b*).

12. A metering device, comprising a housing (1) configured to receive a replaceable receptacle, wherein the receptacle is connected to a disposable pump (10), an electric drive motor (6) configured to drive the disposable pump (10), control means for controlling the drive motor (6) and for influencing the pump volume, an electric power source or an electric connection configured to supply energy to the electric drive motor (6) and the control means, and wherein the housing (1) additionally comprises a receiving means (11) for mounting the disposable pump (10) in a positive locking manner, characterized in that the housing (1) comprises two part shells (7*a*, 7*b*) which are connected together so as to be pivotable and that one elastic squeezing element (12*a*, 12*b*) each is fastened on each part shell (7*a*, 7*b*), between which elastic squeezing elements the replaceable receptacle is held in a clamping manner, wherein the metering device is configured to receive non-dimensionally stable tubular bags (8) without suspending means, characterized in that the elastic squeezing elements (12*a*, 12*b*) are substantially flat and are configured to be fastened on the part shells (7*a*, 7*b*) so as to be insertable, and characterized in that the elastic squeezing elements (12*a*, 12*b*) comprise conical moldings (21) which in an operating position bring about or facilitate concentration of contents of the tubular bag in a direction of a center of the tubular bag and of an outlet of the tubular bag.

* * * * *